US009714479B2

(12) United States Patent
Catallo deceased

(10) Patent No.: US 9,714,479 B2
(45) Date of Patent: Jul. 25, 2017

(54) HEAT SETTER FOR DELICATE AND/OR SENSITIVE KNIT FABRICS

(71) Applicant: Teresa Catallo, Old Westbury, NY (US)

(72) Inventor: Frank Catallo deceased, Old Westbury, NY (US)

(73) Assignee: Teresa Catallo, Old Westbury, NY (US)

( * ) Notice: Subject to any disclaimer, the term of this patent is extended or adjusted under 35 U.S.C. 154(b) by 346 days.

(21) Appl. No.: 14/295,365

(22) Filed: Jun. 4, 2014

(65) Prior Publication Data

US 2015/0354120 A1 Dec. 10, 2015

(51) Int. Cl.
*D06C 7/02* (2006.01)
*D06C 3/02* (2006.01)

(52) U.S. Cl.
CPC ..... *D06C 7/02* (2013.01); *D06C 3/02* (2013.01); *D06C 3/028* (2013.01)

(58) Field of Classification Search
CPC . D06C 3/02; D06C 3/028; D06C 7/02; D06C 7/00; F26B 3/04; F26B 13/10; F26B 13/12; F26B 23/02; F26B 13/101; F26B 13/103; F26B 13/22; F26B 25/06; F26B 25/16
USPC ..... 26/106, 92; 34/629, 646, 658, 209, 210, 34/218, 219, 223
See application file for complete search history.

(56) References Cited

U.S. PATENT DOCUMENTS 2,083,141 A * 6/1937 Buck ..... D06B 1/00 26/92
2,440,648 A * 4/1948 Walter et al. ..... D06C 3/00 26/92
2,773,312 A * 12/1956 Peck ..... F26B 13/005 26/92
2,894,334 A * 7/1959 Thygeson, Sr. ..... F26B 13/10 26/92
3,061,906 A * 11/1962 Coggin ..... D06C 7/02 26/106
3,438,139 A * 4/1969 Holm ..... D06C 29/00 26/1
3,496,647 A * 2/1970 Frezza ..... F26B 13/101 26/106

(Continued)

FOREIGN PATENT DOCUMENTS

WO WO 2012143292 A1 * 10/2012 ..... D06C 3/00

*Primary Examiner* — Amy Vanatta
(74) *Attorney, Agent, or Firm* — Charles E. Baxley

(57) ABSTRACT

A heat setter that heat-sets delicate knit fabrics, sensitive knit fabrics, similar constituted fabrics, and analogously constituted fabrics that may include metal, other threads, and panels in or appended to the delicate knit fabrics and the sensitive knit fabrics, and supports and avoids stretching, marking, and drooping of the delicate knit fabrics and the sensitive knit fabrics going through the heat setter. The heat setter includes a main portion. The main portion heat-sets the delicate knit fabrics, the sensitive knit fabrics, the similar constituted fabrics, and the analogously constituted fabrics that may include the metal, the other threads, and the panels in or appended to the delicate knit fabrics and the sensitive knit fabrics, and supports and avoids the stretching, the marking, and the drooping of the delicate knit fabrics and the sensitive knit fabrics going through the main portion.

17 Claims, 7 Drawing Sheets

(56) References Cited

U.S. PATENT DOCUMENTS

| | | | | | |
|---|---|---|---|---|---|
| 3,629,953 | A | * | 12/1971 | Fleming | F26B 13/10 228/203 |
| 3,827,639 | A | * | 8/1974 | Relue | F26B 13/104 226/196.1 |
| 3,936,915 | A | | 2/1976 | Becker | |
| 3,961,400 | A | | 6/1976 | Schmid | |
| 3,991,482 | A | * | 11/1976 | Brock | F26B 13/10 26/92 |
| 4,219,942 | A | * | 9/1980 | Coliva | F26B 13/101 26/18.5 |
| 4,449,921 | A | | 5/1984 | Catallo | |
| 4,972,560 | A | | 11/1990 | Baum | |
| 5,333,395 | A | * | 8/1994 | Bulcsu | F26B 13/005 34/644 |
| 5,373,613 | A | | 12/1994 | Young | |
| 5,555,610 | A | | 9/1996 | Young | |
| 5,819,382 | A | | 10/1998 | Grief | |
| 5,943,747 | A | * | 8/1999 | Muller | D06C 7/02 26/92 |
| 6,173,507 | B1 | | 1/2001 | Catallo | |
| 6,868,592 | B2 | * | 3/2005 | Freiberg | F26B 13/12 26/89 |
| 7,669,301 | B2 | | 3/2010 | Catallo | |

* cited by examiner

HEAT SETTER FOR DELICATE AND/OR SENSITIVE KNIT FABRICS

BACKGROUND OF THE INVENTION

A. Field of the Invention

The embodiments of the present invention relate to a heat setter, and more particularly, the embodiments of the present invention relate to a heat setter for heat-setting at least one of delicate knit fabrics and sensitive knit fabrics that may include at least one of metal, other threads, and panels disposed at one of in and appended to the at least one of the delicate knit fabrics and the sensitive knit fabrics, and for supporting and avoiding at least one of stretching, marking, and drooping of the at least one of the delicate knit fabrics and the sensitive knit fabrics going through the heat setter.

B. Description of the Prior Art

Numerous innovations for fabric-processing apparatuses have been provided in the prior art, which will be described below in chronological order to show advancement in the art, and which are incorporated in their entirety herein by reference thereto. Even though these innovations may be suitable for the specific individual purposes to which they address, nevertheless, they differ from the embodiments of the present invention in that they do not teach a heat setter for heat-setting at least one of delicate knit fabrics and sensitive knit fabrics that may include at least one of metal, other threads, and panels disposed at one of in and appended to the at least one of the delicate knit fabrics and the sensitive knit fabrics, and for supporting and avoiding at least one of stretching. marking, and drooping of the at least one of the delicate knit fabrics and the sensitive knit fabrics going through the heat setter.

(1) U.S. Pat. No. 3,936,915 to Becker

U.S. Pat. No. 3,936,915—issued to Becker on Feb. 10, 1976 in U.S. class 26 and subclass 57A—teaches a driven feed roller disposed above a pair of needle chains. Members for spreading the web edges are located immediately preceding the feed roller, and a pair of needling rollers for impaling the web edges on the needle chains are located immediately following the feed roller in a direction of web movement. A device for sensing the web edges is arranged to scan the web edges on the feed roller.

(2) U.S. Pat. No. 3,961,400 to Schmid

U.S. Pat. No. 3,961,400—issued to Schmid on Jun. 8, 1976 in U.S. class 26 and subclass 80—teaches a perforated drum drier having a first lower inlet opening in a rear wall of a drier housing for feeding a tubular knit fabric to a first drum in the housing, and having a substantially horizontal stentering chain mechanism extending through a second upper inlet opening into the housing to a front guide roller for two pin-studded stentering chains. The axis of the stentering chains is located ahead of a vertical plane extending through the axis of the first drum, and is so far above the first drum that the parts of lower stringers of the chains adjacent to the front guide roller are substantially in horizontal alignment with a top of the first drum, so that an open fabric is removed from the pins of the chains by its own gravity and by suction of the first drum, and the fabric is transferred simultaneously to this drum.

(3) U.S. Pat. No. 4,449,921 to Catallo

U.S. Pat. No. 4,449,921—issued to Catallo on May 22, 1984 in U.S. class 432 and subclass 8—teaches a combined oven and fume incinerator having an enclosed housing. A combustion chamber serving as a heat source and fume incinerator is connected by a heat recovery air duct to a process zone that in turn opens into a cool air inlet passage leading to the combustion chamber. A blower apparatus circulates air through the housing, the combustion chamber, the heat recovery duct, the process zone, the cool air inlet passage, and back to the combustion chamber. The heat recovery duct is in direct thermal contact with the cool air inlet passage. An exhaust fan is located in the cool air inlet passage.

(4) U.S. Pat. No. 4,972,560 to Baum

U.S. Pat. No. 4,972,560—issued to Baum on Nov. 27, 1990 in U.S. class 26 and subclass 96—teaches an apparatus for a tenter frame, which feeds a fabric web to a nip region of vertical pins and cooperating rollers of a pair of endless belt assemblies that transport the web through a drying chamber. The apparatus includes a guide member that guides the web into the nip at a relatively steep angle, preferably, in the range of 30° to 60°. The guide member is supported on a pair of swivel supports. Each of the swivel supports is movably supported on one of the endless belt assemblies. Additionally, the guide member is a roller rotatable about its axial length, which is rotated in synchronization with the feed of the web.

(5) U.S. Pat. No. 5,373,613 to Young Jr. et al

U.S. Pat. No. 5,373,613—issued to Young Jr. et al. on Dec. 20, 1994 in U.S. class 26 and subclass 96—teaches a tenter frame for treating web materials, such as woven or knitted fabrics, film, or the like. Apparatus removes a web from a tenter while controlling the web, and a process removes the web from the tenter. A pair of endless and opposed tenter chains having a plurality of pins thereon engaging opposite edges of the web material are for holding the web material as the web material is treated on the tenter frame. Pinned rolls engage and transfer the web material from the pins of the tenter frame. A cutter unit trims the edges from the web after the web has been removed from the tenter chain, while the web remains under control of the pinned rolls, after which, trimmed edges are automatically removed from the pins for discarding.

(6) U.S. Pat. No. 5,555,610 to Young Jr. et al

U.S. Pat. No. 5,555,610—issued to Young Jr. et al. on Sep. 17, 1996 in U.S. class 26 and subclass 96—teaches a tenter frame for treating web materials, such as woven or knitted fabrics, film, or the like. Apparatus removes a web from a tenter while controlling the web, and a process removes the web from the tenter. A pair of endless and opposed tenter chains having a plurality of pins thereon engaging opposite edges of the web material are for holding the web material as the web material is treated on the tenter frame. Pinned rolls engage and transfer the web material from the pins of the tenter frame. A cutter unit trims edges from the web after the web has been removed from the tenter chain, while the web remains under control of the pinned rolls, after which, trimmed edges are automatically removed from the pins for discarding.

(7) U.S. Pat. No. 5,819,382 to Greif et al

U.S. Pat. No. 5,819,382—issued to Greif et al. on Oct. 13, 1998 in U.S. class 26 and subclass 90—teaches a width stretching unit for textile webs, which includes a first needle disc unit having first and second needle discs disposed along a first axis at a distance corresponding to the width of the web of material, and a second needle disc unit having a second axis that is situated in a pivoting plane parallel to the first axis and having third and forth needle discs arranged perpendicular to the second axis, which rotate about the second axis with a same peripheral speed as the first and the second needle discs. An axial distance between the third and the fourth needle discs is equal to an axial distance between the first and the second needle discs in a zone of increased distance between the first and the second needle discs. The edges of the first and the third needle discs and the edges of the second and the fourth needle discs practically touch one another in a zone of increased distance, so that the web of material is transferred from the first and the second needle discs to the third and the fourth needle discs, respectively, without relinquishing the attachment of the web to the needles on at least one of the first and the third needle discs and at least one of the second and the fourth needle discs.

(8) U.S. Pat. No. 6,173,507 to Catallo

U.S. Pat. No. 6,173,507—issued to Catallo on Jan. 16, 2001 in U.S. class 34 and subclass 397—teaches an apparatus and a related method control for residual shrinkage in garments to be made from a knitted fabric web or other fabrics subject to high shrinkage. The knitted fabric web is passed continuously in a moist condition through a first shrinkage compactor. Then the web is carried on an endless belt through a dryer in a relaxed condition to allow loops of knits to shorten. The web is caused to wave in the dryer. The web is then conveyed through a second shrinkage range for final shrinking to a desired weight per surface area with less than 2% residual shrinkage.

(9) U.S. Pat. No. 7,669,301 to Catallo

U.S. Pat. No. 7,669,301—issued to Catallo on Mar. 2, 2010 in U.S. class 26 and subclass 89—teaches a modular tenter frame for guiding a pair of chains with pins through a predetermined path to transport an open-width tubular-knit web through a drying oven and/or a steaming station to a compressive treating station. The frame includes a rail section. The rail section guides an associated chain with the pins through the predetermined path to transport the open-width tubular-knit web through the drying oven and/or the steaming station to the compressive treating station. The rail section has a pair of recessed tracks that are longitudinal, face in a same direction, are spaced-apart from each other by a space therebetween defined by a web, and receive the chains.

It is apparent that numerous innovations for fabric-processing apparatuses have been provided in the prior art. Furthermore, even though these innovations may be suitable for the specific purposes to which they address, nevertheless, they would not be suitable for the purposes of the embodiments of the present invention as heretofore described, namely, a heat setter for heat-setting at least one of delicate knit fabrics and sensitive knit fabrics that may include at least one of metal, other threads, and panels disposed at one of in and appended to the at least one of the delicate knit fabrics and the sensitive knit fabrics, and for supporting and avoiding at least one of stretching marking, and drooping of the at least one of the delicate knit fabrics and the sensitive knit fabrics going through the heat setter.

SUMMARY OF THE INVENTION

Thus, an object of the embodiments of the present invention is to provide a heat setter for heat-setting at least one of delicate knit fabrics and sensitive knit fabrics that may include at least one of metal, other threads, and panels disposed at one of in and appended to the at least one of the delicate fabrics and the sensitive knit fabrics, and for supporting and avoiding at least one of stretching, marking, and drooping of the at least one of the delicate knit fabrics and the sensitive knit fabrics going through the heat setter, which avoids the disadvantages of the prior art.

Briefly stated, another object of the embodiments of the present invention is to provide a heat setter that heat-sets at least one of delicate knit fabrics, sensitive knit fabrics, similar constituted fabrics, and analogously constituted fabrics that may include at least one of metal, other threads, and panels disposed at one of in and appended to the at least one of delicate knit fabrics and the sensitive knit fabrics, and supports and avoids at least one of stretching, marking, and drooping of the at least one of the delicate knit fabrics and the sensitive knit fabrics going through the heat setter. The heat setter includes a main portion. The main portion heat-sets the at least one of the delicate knit fabrics, the sensitive knit fabrics, the similar constituted fabrics, and the analogously constituted fabrics that may include the at least one of the metal, the other threads, and the panels disposed at one of in and appended to the at least one of the delicate knit fabrics and the sensitive knit fabrics, and supports and avoids the at least one of the stretching, the marking, and the drooping of the at least one of the delicate knit fabrics and the sensitive knit fabrics going through the main portion.

The novel features considered characteristic of the embodiments of the present invention are set forth in the appended claims. The embodiments of the present invention themselves, however, both as to their construction and to their method of operation together with additional objects and advantages thereof will be best understood from the following description of the embodiments of the present invention when read and understood in connection with the accompanying figures of the drawing.

LIST OF REFERENCE NUMERALS UTILIZED IN THE FIGURES OF THE DRAWING

Figure 1:
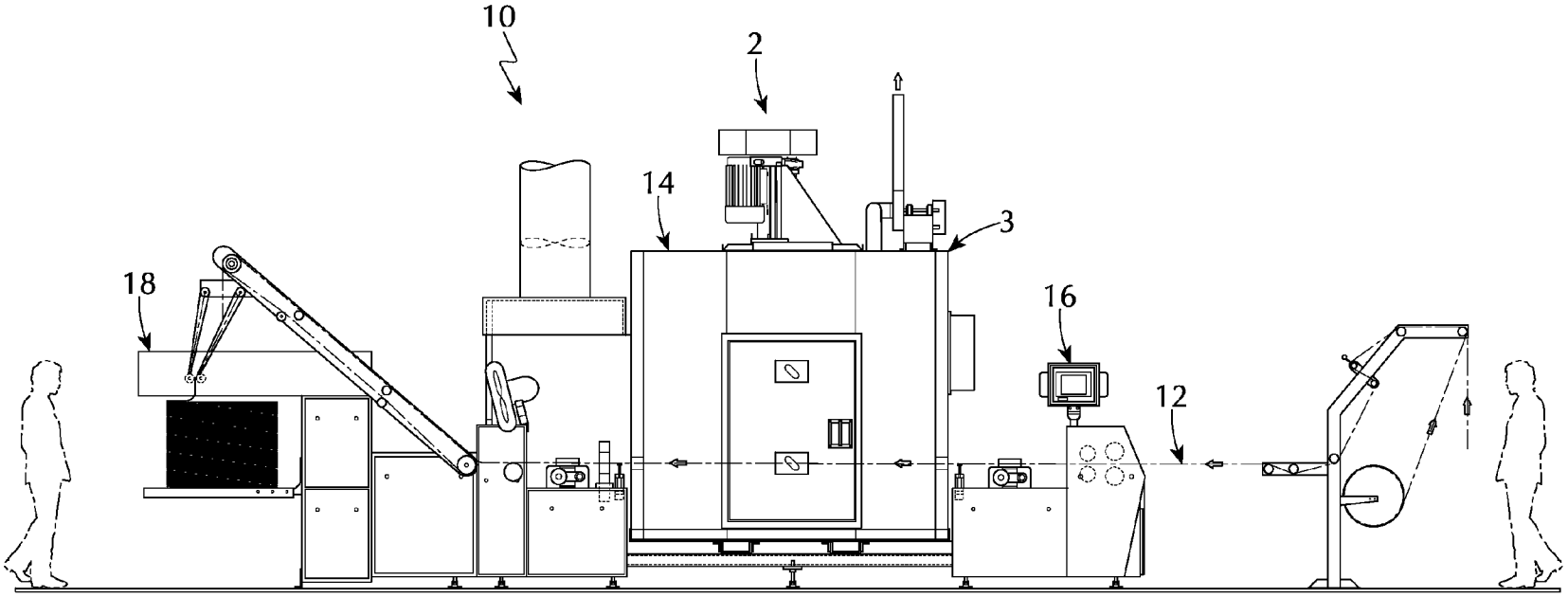
FIG. 1 is a diagrammatic side elevational view of the heat setter of the embodiments of the present invention heat-setting at least one of delicate knit fabrics and sensitive knit fabrics that may include at least one of metal, other threads, and panels disposed at one of in and appended to the at least one of the delicate knit fabrics and the sensitive knit fabrics, and supporting and avoiding at least one of stretching, marking, and drooping of the at least one of the delicate knit fabrics and the sensitive knit fabrics going through the heat setter.

A. Introductory.

10 heat setter of embodiments of present invention for heat-setting at least one of delicate knit fabrics, sensitive knit fabrics, similar constituted fabrics, and analogously constituted fabrics 12 that may include at least one of metal, other threads, and panels disposed at one of in and appended to at least one of delicate knit fabrics and sensitive knit fabrics 12, and for supporting and avoiding at least one of stretching, marking, and drooping of the at least one of the delicate knit fabrics and sensitive knit fabrics 12 going through heat setter 10

12 at least one of delicate knit fabrics, sensitive knit fabrics, similar constituted fabrics, and analogously constituted fabrics B. Overall Configuration of Heat Setter 10.

14 main portion for heat-setting at least one of delicate knit fabrics, sensitive knit fabrics, similar constituted fabrics, and analogously constituted fabrics 12 that may include at least one of metal, other threads, and panels disposed at one of in and appended to at least one of delicate knit fabrics and sensitive knit fabrics 12, and for supporting and avoiding at least one of stretching, marking, and drooping of at least one of delicate knit fabrics and sensitive knit fabrics 12 going through main portion 14

16 fabric detwister and spreader for detwisting and spreading at least one of delicate knit fabrics and sensitive knit fabrics 12 prior to at least one of delicate knit fabrics and sensitive knit fabrics 12 being fed into main portion 14, and for facilitating moving at least one of delicate knit fabrics and sensitive knit fabrics 12 while maintaining width of at least one of delicate knit fabrics and sensitive knit fabrics 12

18 fabric receiver for receiving and protecting at least one of delicate knit fabrics and sensitive knit fabrics 12 after at least one of delicate knit fabrics and sensitive knit fabrics 12 has exited main portion 14

C. Specific Configuration of Main Portion 14.

20 heater assembly of main portion 14 for heat-setting at least one of delicate knit fabrics and sensitive knit fabrics 12 that may include at least one of metal, other threads, and panels disposed at one of in and appended to at least one of delicate knit fabrics and sensitive knit fabrics 12

22 support assembly of main portion 14

24 heating zone of heater assembly 20 of main portion 14

26 housing of main portion 14 for resting on support surface 28

28 support surface

D. Specific Configuration of Heater Assembly 20 of Main Portion 14.

30 gas-fired burner of heater assembly 20 of main portion 14

32 heated air

34 passageway of heating zone 24 of heater assembly 20 of main portion 14

36 upper nozzle plenum of heater assembly 20 of main portion 14

38 upper nozzles of heater assembly 20 of main portion 14

40 lower nozzle plenum of heater assembly 20 of main portion 14

42 lower nozzles of heater assembly 20 of main portion 14

44 exhaust fan of heater assembly 20 of main portion 14

45 input fan of heater assembly 20 of main portion 14

46 ARROWS

48 ARROWS

50 ARROWS

52 ARROWS

E. Specific Configuration of Support Assembly 22 of Main Portion 14.

54 tenter frame of support assembly 22 of main portion 14 for assisting in moving at least one of delicate knit fabrics and sensitive knit fabrics 22 through heating zone 24 of heater assembly 20 of main portion 14 so as to preserve width of at least one of delicate knit fabrics and sensitive knit fabrics 22 as at least one of delicate knit fabrics and sensitive knit fabrics 22 passes through heating zone 24 of heater assembly 20 of main portion 14

56 array of hollow tubes of support assembly 22 for supporting and avoiding at least one of stretching, marking, and drooping of at least one of delicate knit fabrics and sensitive knit fabrics 12 going through heating zone 24 of heater assembly 20 of main portion 14

58 coolant of support assembly 22

60 spargers of support assembly 22

62 each end of array of hollow tubes 56 of support assembly 22

DETAILED DESCRIPTION OF THE PREFERRED EMBODIMENTS

A. Introductory.

Figure 2:
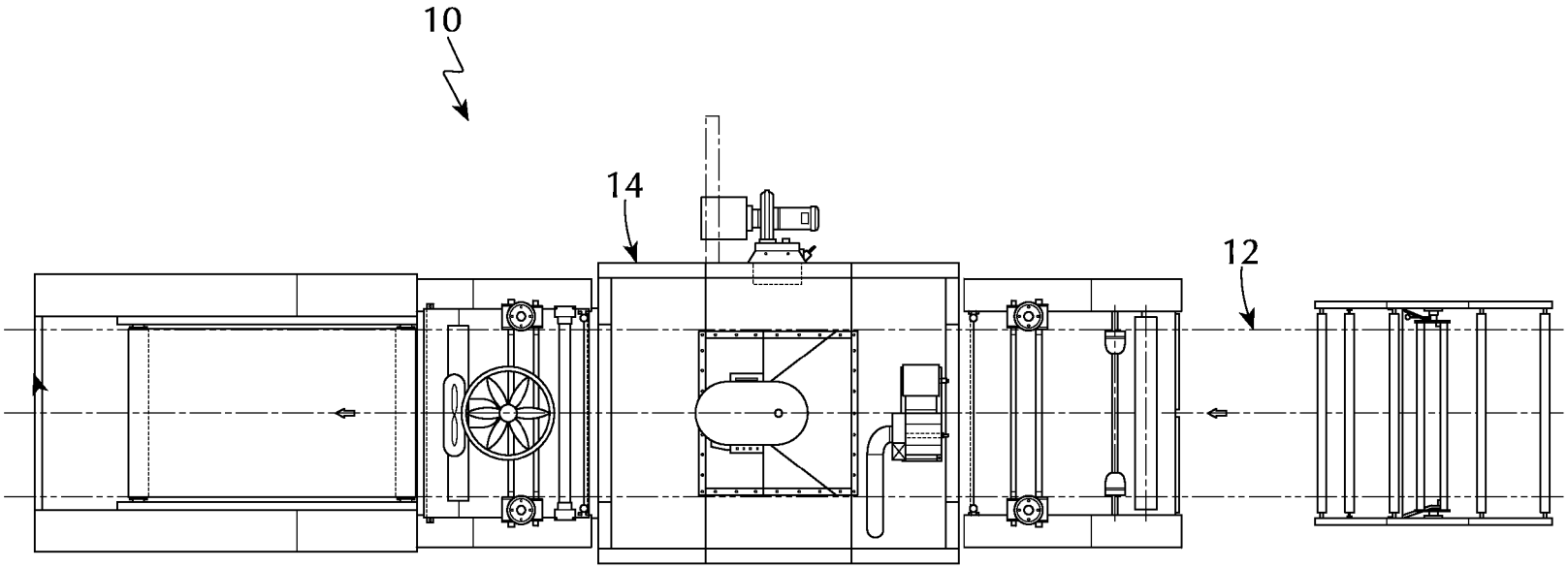
FIG. 2 is diagrammatic top plan view of the heat setter of the embodiments of the present invention taken generally in the direction of ARROW 2 in FIG. 1.
Figure 3:
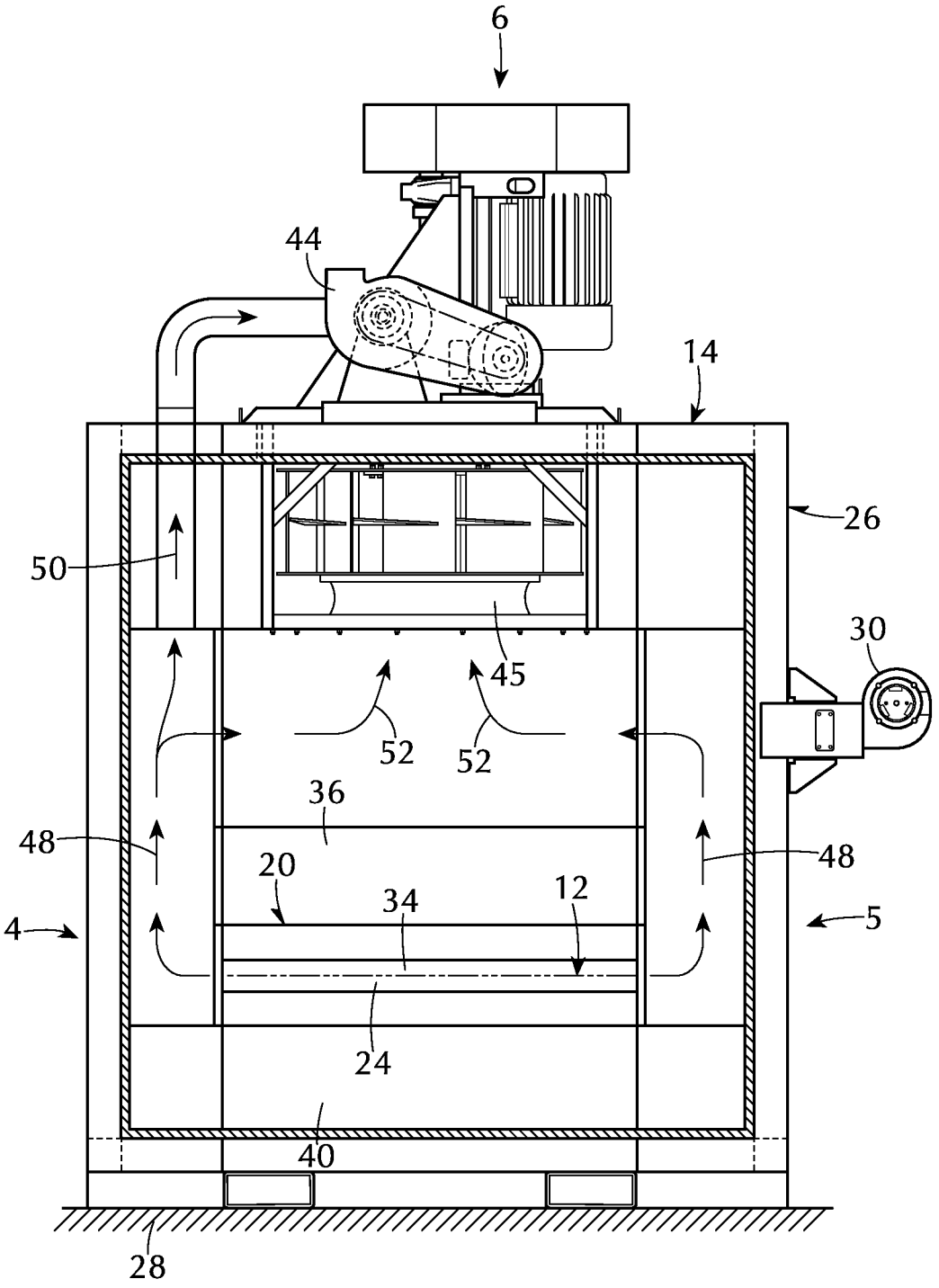
FIG. 3 is an enlarged diagrammatic front view of the main portion of the heat setter of the embodiments of the present invention identified by ARROW 3 in FIG. 1.
Figure 4:
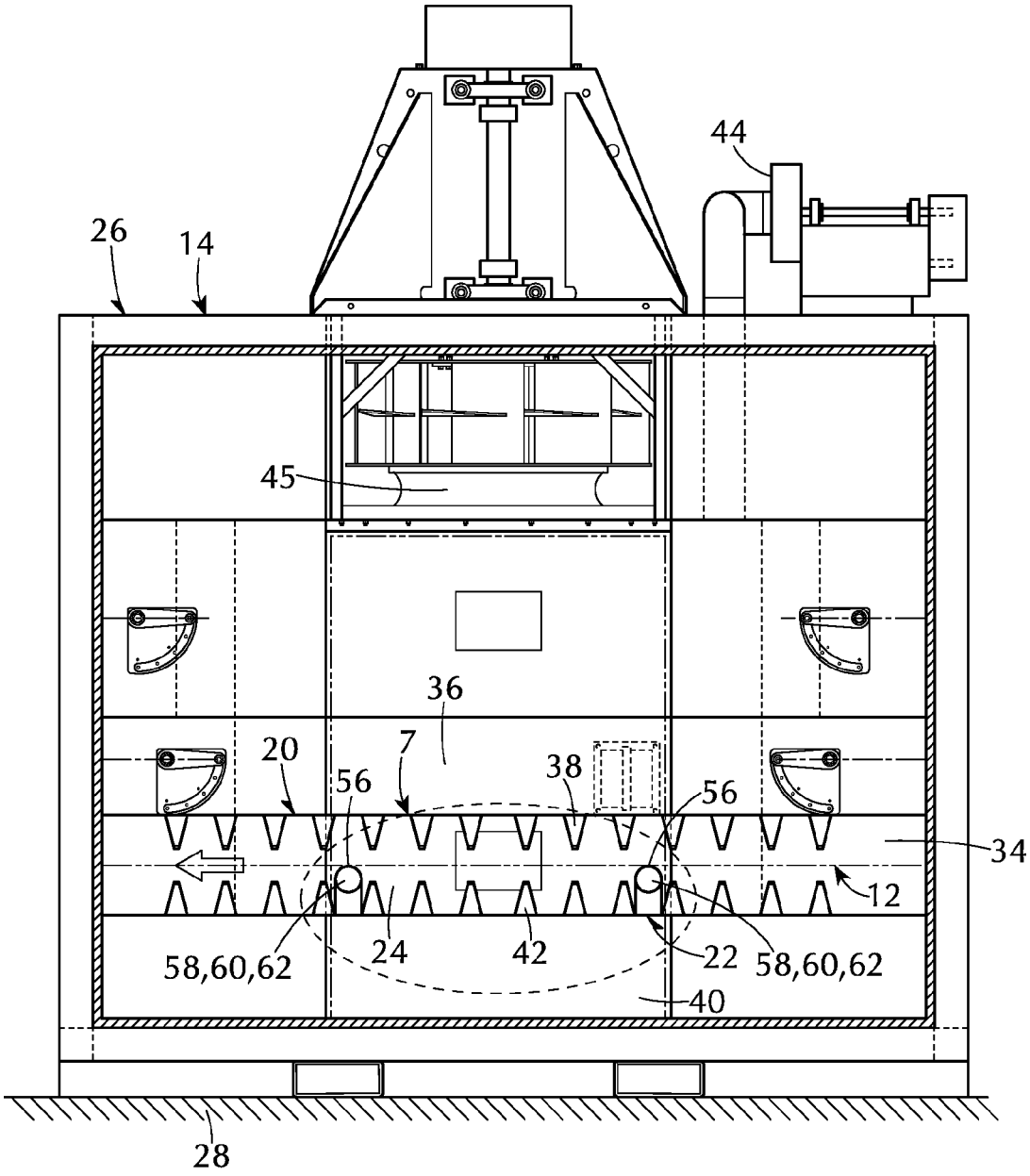
FIG. 4 is diagrammatic side elevational view of the main portion of the heat setter of the embodiments of the present invention identified by ARROW 4 in FIG. 3.
Figure 5:
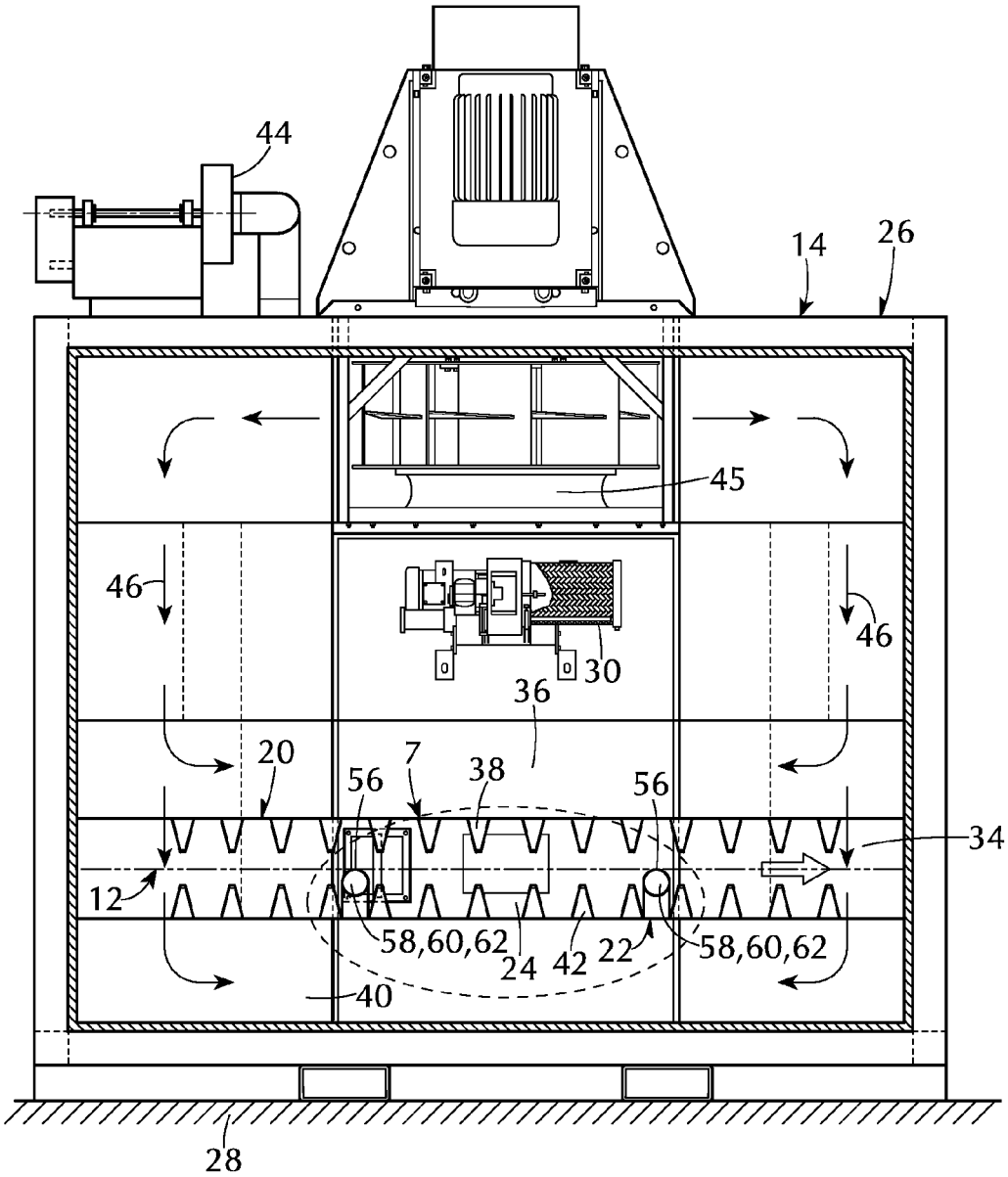
FIG. 5 is diagrammatic opposite side elevational view of the main portion of the heat setter of the embodiments of the present invention identified by ARROW 5 in FIG. 3.
Figure 6:
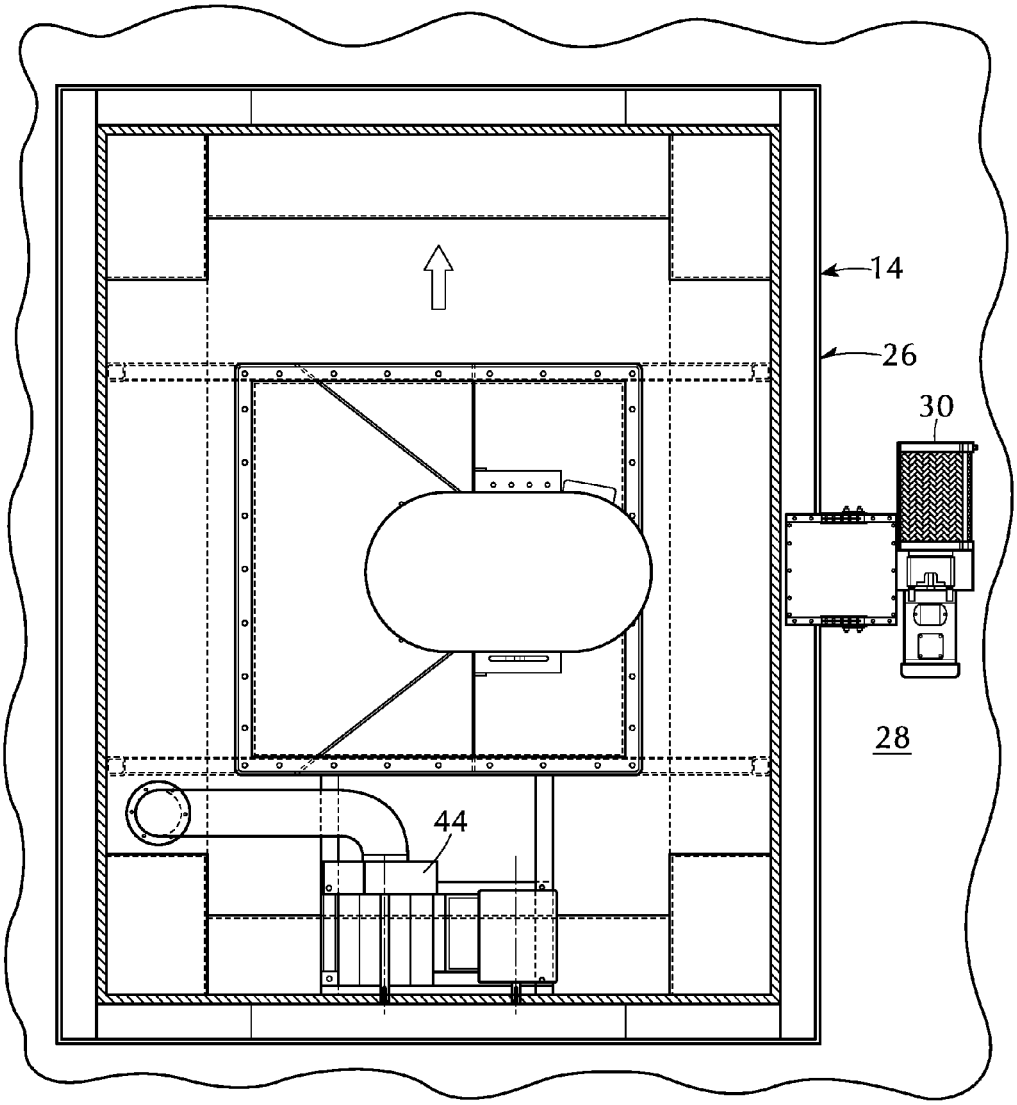
FIG. 6 is diagrammatic top plan view of the main portion of the heat setter of the embodiments of the present invention identified by ARROW 6 in FIG. 3.
Figure 7:
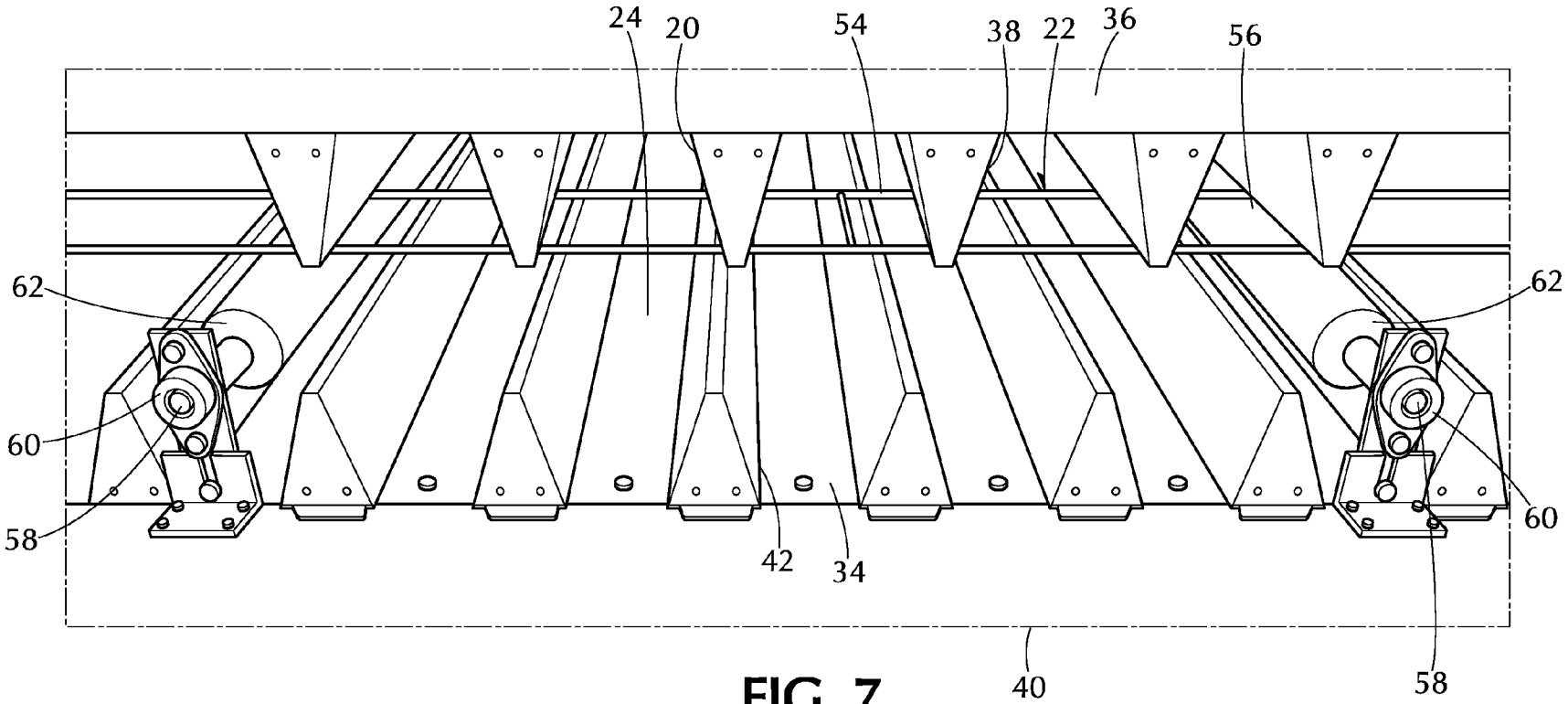
FIG. 7 is an enlarged diagrammatic perspective view of the area generally enclosed by the dotted curve identified by ARROW 7 in FIGS. 4 and 5.

Referring now to the figures of the drawing, in which like numerals indicate like parts, and particularly to FIGS. 1 and 2, the heat setter of the embodiments of the present invention is shown generally at 10 for heat-setting at least one of delicate knit fabrics, sensitive knit fabrics, similar constituted fabrics, and analogously constituted fabrics 12 that may include at least one of metal, other threads, and panels disposed at one of in and appended to the at least one of the delicate knit fabrics and the sensitive knit fabrics 12, and for supporting and avoiding at least one of stretching, marking, and drooping of the at least one of the delicate knit fabrics and the sensitive knit fabrics 12 going through the heat setter 10.

B. Overall Configuration of the Heat Setter 10.

The heat setter 10 comprises a main portion 14.

The main portion 14 is for heat-setting the at least one of the delicate knit fabrics, the sensitive knit fabrics, the similar constituted fabrics, and the analogously constituted fabrics 12 that may include the at least one of the metal, the other threads, and the panels disposed at one of in and appended to the at least one of the delicate knit fabrics and the sensitive knit fabrics 12. The main portion 14 is further for supporting and avoiding the at least one of the stretching, the marking, and the drooping of the at least one of the delicate knit fabrics and the sensitive knit fabrics 12 going through the main portion 14.

The heat setter 10 further comprises a fabric detwister and spreader 16.

The fabric detwister and spreader 16 is operatively connected to, and upstream of, the main portion 14, is for detwisting and spreading the at least one of the delicate knit fabrics and the sensitive knit fabrics 12 prior to the at least one of the delicate knit fabrics and the sensitive knit fabrics 12 being fed into the main portion 14, and is for facilitating moving the at least one of the delicate knit fabrics and the sensitive knit fabrics 12 while maintaining the width of the at least one of the delicate knit fabrics and the sensitive knit fabrics 12.

The heat setter 10 further comprises a fabric receiver 18.

The fabric receiver 18 is operatively connected to, and downstream of, the main portion 14, and is for receiving and protecting the at least one of the delicate knit fabrics and the sensitive knit fabrics 12 after the at least one of the delicate knit fabrics and the sensitive knit fabrics 12 has exited the main portion 14.

C. The Specific Configuration of the Main Portion 14.

The specific configuration of the main portion 14 can best be seen in FIGS. 3-7, and as such, will be discussed with reference thereto.

The main portion 14 comprises a heater assembly 20.

The heater assembly 20 of the main portion 14 is for heat-setting the at least one of the delicate knit fabrics and the sensitive knit fabrics 12 that may include the at least one of the metal, the other threads, and the panels disposed at one of in and appended to the at least one of the delicate knit fabrics and the sensitive knit fabrics 12.

The main portion 14 further comprises a support assembly 22.

The support assembly 22 of the main portion 14 is disposed in operative relationship with the heater assembly 20 of the main portion 14, forms a heating zone 24 with the heater assembly 20 of the main portion 14, and is arranged for supporting and avoiding the at least one of the stretching, the marking, and the drooping of the at least one of the delicate knit fabrics and the sensitive knit fabrics 12 going through the heater assembly 20 of the main portion 14.

The main portion 14 further comprises a housing 26.

The housing 26 of the main portion 14 is for resting on a support surface 28.

D. The Specific Configuration of the Heater Assembly 20 of the Main Portion 14.

The heater assembly 20 of the main portion 14 comprises a gas-fired burner 30.

The gas-fired burner 30 of the heater assembly 20 of the main portion 14 is disposed on, but external to, the housing 26 of the main portion 14, and supplies heated air 32 to the heating zone 24 of the heater assembly 20 of the main portion 14.

The heating zone 24 of the heater assembly 20 of the main portion 14 includes a passageway 34.

The passageway 34 of the heating zone 24 of the heater assembly 20 of the main portion 14 is internal to the housing 26 of the main portion 14, and provides a passage for the heated air 32 for contacting, and passing through, the at least one of the delicate knit fabrics and the sensitive knit fabrics 12.

The heater assembly 20 of the main portion 14 further comprises an upper nozzle plenum 36.

The upper nozzle plenum 36 of the heater assembly 20 of the main portion 14 is internal to the housing 26 of the main portion 14, and receives the heated air 32.

The heater assembly 20 of the main portion 14 further comprises upper nozzles 38.

The upper nozzles 38 of the heater assembly 20 of the main portion 14 are in fluid communication with the upper nozzle plenum 36 of the heater assembly 20 of the main portion 14 to distribute the heated air 32 to the passageway 34 of the heating zone 24 of the heater assembly 20 of the main portion 14.

The heater assembly 20 of the main portion 14 further comprises a lower nozzle plenum 40.

The lower nozzle plenum 40 of the heater assembly 20 of the main portion 14 is internal to the housing 26 of the main portion 14, and receives the heated air 32.

The heater assembly 20 of the main portion 14 further comprises lower nozzles 42. The lower nozzles 42 of the heater assembly 20 of the main portion 14 are in fluid communication with the lower nozzle plenum 40 of the heater assembly 20 of the main portion 14 to distribute the heated air 32 to the passageway 34 of the heating zone 24 of the heater assembly 20 of the main portion 14.

The heater assembly 20 of the main portion 14 further comprises an exhaust fan 44.

The exhaust fan 44 of the heater assembly 20 of the main portion 14 is disposed on top of the housing 26 of the main portion 14, and fluidly communicates with the passageway 34 of the heating zone 24 of the heater assembly 20 of the main portion 14.

The heater assembly 20 of the main portion 14 further comprises an input fan 45.

The input fan 45 of the heater assembly 20 of the main portion 14 is disposed internal to the housing 26 of the main portion 14, at an uppermost portion thereof.

In operation, as shown by ARROWS 46, the input fan 45 of the heater assembly 20 of the main portion 14 pressurizes and forces the heated air 32 into the upper nozzle plenum 36 of the heater assembly 20 of the main portion 14 and the lower nozzle plenum 40 of the heater assembly 20 of the main portion 14. The heated air 32 leaves the upper nozzle plenum 36 of the heater assembly 20 of the main portion 14 and the lower nozzle plenum 40 of the heater assembly 20 of the main portion 14 and enters the upper nozzles 38 of the heater assembly 20 of the main portion 14 and the lower nozzles 42 of the heater assembly 20 of the main portion 14, respectively. The heated air 32 leaves the upper nozzles 38 of the heater assembly 20 of the main portion 14 and the lower nozzles 42 of the heater assembly 20 of the main portion 14 and enters into the passageway 34 of the heating zone 24 of the heater assembly 20 of the main portion 14 for interfacing with the at least one of the delicate knit fabrics and the sensitive knit fabrics 12. As shown by ARROWS 48, the heated air 32 leaves the passageway 34 of the heating zone 24 of the heater assembly 20 of the main portion 14 where, as shown by ARROWS 50, the exhaust fan 44 of the heater assembly 20 of the main portion 14 exhausts the heated air 32 therefrom, while, as shown by ARROWS 52, a portion returns.

E. The Specific Configuration of the Support Assembly 22 of the Main Portion 14.

The support assembly 22 of the main portion 14 comprises a tenter frame 54.

The tenter frame 54 of the support assembly 22 of the main portion 14 is internal to the housing 26 of the main portion 14, traverses the heating zone 24 of the heater assembly 20 of the main portion 14, and is for assisting in moving the at least one of the delicate knit fabrics and the sensitive knit fabrics 22 through the heating zone 24 of the heater assembly 20 of the main portion 14 so as to preserve the width of the at least one of the delicate knit fabrics and the sensitive knit fabrics 22 as the at least one of the delicate knit fabrics and the sensitive knit fabrics 22 passes through the heating zone 24 of the heater assembly 20 of the main portion 14, as opposed to, as taught by the prior art, by one of drawing the at least one of the delicate knit fabrics and the sensitive knit fabrics 22 through the heating zone 24 of the heater assembly 20 of the main portion 14 by tension on the at least one of the delicate knit fabrics and the sensitive knit fabrics 22, which likely would decrease the width of the at least one of the delicate knit fabrics and the sensitive knit fabrics 22 and by one of wire brush rollers and wires spanning the heating zone 24 of the heater assembly 20 of the main portion 14 that tend to at least one of damage, mark, and streak the at least one of the delicate knit fabrics and the sensitive knit fabrics 22.

The support assembly 22 further comprises an array of hollow tubes 56.

The array of hollow tubes 56 of the support assembly 22 are disposed internal to the housing 26, are for supporting and avoiding the at least one of the stretching, the marking, and the drooping of the at least one of the delicate knit fabrics and the sensitive knit fabrics 12 going through the heating zone 24 of the heater assembly 20 of the main portion 14, and are sized and cooled to perform their intended roles, as opposed to, as taught by the prior art, using longitudinal wires that mark the at least one of the delicate knit fabrics and the sensitive knit fabrics 12.

Spacing and sizing of the array of hollow tubes 56 of the support assembly 22 must take into account that the array of hollow tubes 56 of the support assembly 22 are to support the moving of the at least one of the delicate knit fabrics and the sensitive knit fabrics 12 as the at least one of the delicate knit fabrics and the sensitive knit fabrics 12 traverses the heating zone 24 of the heater assembly 20 of the main portion 14, as well as keep the array of hollow tubes 56 of the support assembly 22 from overheating the at least one of the delicate knit fabrics and the sensitive knit fabrics 12.

Cylindrical tubes for the array of hollow tubes 56 of the support assembly 22 are generally preferred because of economics, yet non-cylindrical tubes for the array of hollow tubes 56 of the support assembly 22 could also be used.

The array of hollow tubes 56 of the support assembly 22 are shown horizontally oriented, however, the array of hollow tubes 56 of the support assembly 22 are arrangeable longitudinally or otherwise so long as the array of hollow tubes 56 of the support assembly 22 do not damage the at least one of the delicate knit fabrics and the sensitive knit fabrics 12, i.e., the array of hollow tubes 56 of the support assembly 22 can be arranged perpendicularly, horizontally, diagonally, or otherwise relative to a path of the at least one of the delicate knit fabrics and the sensitive knit fabrics 12, however, transverse organization of the array of hollow tubes 56 of the support assembly 22 relative to the path of the at least one of the delicate and the sensitive knit fabrics 12 is preferred for maximum heat exchange.

When the array of hollow tubes 56 of the support assembly 22 are arranged transversely relative to the path of the at least one of the delicate knit fabrics and the sensitive knit fabrics 12, the array of hollow tubes 56 of the support assembly 22 introduce a waving effect to keep the at least one of the delicate knit fabrics and the sensitive knit fabrics 12 from overheating on the array of hollow tubes 56 of the support assembly 22.

The array of hollow tubes 56 of the support assembly 22 can be manifolded.

The support assembly 22 further comprises a coolant 58.

The coolant 58 of the support assembly 22 passes in, and is circulated by, the array of hollow tubes 56 of the support assembly 22, flows counter to the path of the at least one of the delicate knit fabrics and the sensitive knit fabrics 12, and is at least one of air, water, an inert gas, and one of a commercially available liquid coolant and a commercially available gaseous coolant.

The array of hollow tubes 56 of the support assembly 22 and the coolant 58 of the support 22 are of materials selected as being suited for support of, heat exchange of, and delivery of, the at least one of the delicate knit fabrics and the sensitive knit fabrics 12.

The support assembly 22 further comprises spargers 60.

The spargers 60 of the support assembly 22 are disposed at each end 62 of the array of hollow tubes 56 of the support assembly 22, respectively, are shaped to provide a smooth flow of the at least one of the delicate knit fabrics and the sensitive knit fabrics 12 onto, and away from, the array of hollow tubes 56 of the support assembly 22, and deliver the coolant 58 of the support assembly 22 to, and collect the coolant 58 of the support assembly 22 from, the array of hollow tubes 56 of the support assembly 22.

F. Impressions.

It will be understood that each of the elements described above, or two or more together, may also find a useful application in other types of constructions differing from the types described above.

While the embodiments of the present invention have been illustrated and described as embodied in a heat setter for delicate and/or sensitive knit fabrics, nevertheless, they are not limited to the details shown because it is understood that various omissions, modifications, substitutions, and changes in the forms and details of the embodiments of the present invention illustrated and their operation can be made by those skilled in the art without departing from a main theme or spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A heat setter for heat-setting at least one of delicate knit fabrics and sensitive knit fabrics having a width and that may include at least one of metal, other threads, and panels disposed at one of in and appended to the at least one of the delicate knit fabrics and the sensitive knit fabrics, and for supporting and avoiding at least one of stretching, marking, and drooping of the at least one of the delicate knit fabrics and the sensitive knit fabrics going through the heat setter, said heat setter comprising:

a main portion;

wherein said main portion is for heat-setting the at least one of the delicate knit fabrics and the sensitive knit fabrics that may include the at least one of the metal, the other threads, and the panels disposed at one of in and appended to the at least one of the delicate knit fabrics and the sensitive knit fabrics;

wherein said main portion is for supporting and avoiding the at least one of the stretching, the marking, and the drooping of the at least one of the delicate knit fabrics and the sensitive knit fabrics going through the main portion;

wherein said main portion comprises a heater assembly;

wherein said main portion comprises a housing;

wherein said heater assembly of said main portion comprises an input fan; and wherein said input fan of said heater assembly of said main portion is disposed internal to said housing of said main portion, at an uppermost portion thereof;

wherein said heater assembly of said main portion is for heat-setting the at least one of the delicate knit fabrics and the sensitive knit fabrics that may include the at least one of the metal, the other threads, and the panels disposed at one of in and appended to the at least one of the delicate knit fabrics and the sensitive knit fabrics;

wherein said main portion comprises a support assembly;

wherein said support assembly of said main portion is disposed in operative relationship with said heater assembly of said main portion;

wherein said support assembly of said main portion forms a heating zone with said heater assembly of said main portion;

wherein said support assembly of said main portion is arranged for supporting and avoiding the at least one of the stretching, the marking, and the drooping of the at least one of the delicate knit fabrics and the sensitive knit fabrics going through said heater assembly of said main portion;

wherein said housing of said main portion is for resting on a support surface;

wherein said heater assembly of said main portion comprises a gas-fired burner;

wherein said gas-fired burner of said heater assembly of said main portion is disposed on said housing of said main portion;

wherein said gas-fired burner of said heater assembly of said main portion is external to said housing of said main portion; and wherein said gas-fired burner of said heater assembly of said main portion supplies heated air to said heating zone of said heater assembly of said main portion.

2. The heat setter of claim 1, further comprising a fabric detwister and spreader;

wherein said fabric detwister and spreader is operatively connected to said main portion;

wherein said fabric detwister and spreader is upstream of said main portion;

wherein said fabric detwister and spreader is for detwisting and spreading the at least one of the delicate knit fabrics and the sensitive knit fabrics prior to the at least one of the delicate knit fabrics and the sensitive knit fabrics being fed into said main portion; and wherein said fabric detwister and spreader is for facilitating moving the at least one of the delicate knit fabrics and the sensitive knit fabrics, while maintaining the width of the at least one of the delicate knit fabrics and the sensitive knit fabrics.

3. The heat setter of claim 1, further comprising a fabric receiver;

wherein said fabric receiver is operatively connected to said main portion;

wherein said fabric receiver is downstream of said main portion; and wherein said fabric receiver is for receiving and protecting the at least one of the delicate knit fabrics and the sensitive knit fabrics after the at least one of the delicate knit fabrics and the sensitive knit fabrics has exited said main portion.

4. The heat setter of claim 1, wherein said heating zone of said heater assembly of said main portion includes a passageway;

wherein said passageway of said heating zone of said heater assembly of said main portion is internal to said housing of said main portion; and wherein said passageway of said heating zone of said heater assembly of said main portion provides a passage for said heated air for contacting, and passing through, the at least one of the delicate knit fabrics and the sensitive knit fabrics.

5. The heat setter of claim 4, wherein said heater assembly of said main portion comprises an upper nozzle plenum;

wherein said upper nozzle plenum of said heater assembly of said main portion is internal to said housing of said main portion; and wherein said upper nozzle plenum of said heater assembly of said main portion receives said heated air.

6. The heat setter of claim 5, wherein said heater assembly of said main portion comprises upper nozzles; and wherein said upper nozzles of said heater assembly of said main portion are in fluid communication with said upper nozzle plenum of said heater assembly of said main portion to distribute said heated air to said passageway of said heating zone of said heater assembly of said main portion.

7. The heat setter of claim 6, wherein said heater assembly of said main portion comprises a lower nozzle plenum;

wherein said lower nozzle plenum of said heater assembly of said main portion is internal to said housing of said main portion; and wherein said lower nozzle plenum of said heater assembly of said main portion receives said heated air.

8. The heat setter of claim 7, wherein said heater assembly of said main portion comprises lower nozzles; and wherein said lower nozzles of said heater assembly of said main portion are in fluid communication with said lower nozzle plenum of said heater assembly of said main portion to distribute said heated air to said passageway of said heating zone of said heater assembly of said main portion.

9. The heat setter of claim 8, wherein said heater assembly of said main portion comprises an exhaust fan;

wherein said exhaust fan of said heater assembly of said main portion is disposed on top of said housing of said main portion; and wherein said exhaust fan of said heater assembly of said main portion fluidly communicates with said passageway of said heating zone of said heater assembly of said main portion.

10. The heat setter of claim 1, wherein said input fan of said heater assembly of said main portion pressurizes and forces heated air into an upper nozzle plenum of said heater assembly of said main portion and a lower nozzle plenum of said heater assembly of said main portion;

wherein said heated air leaves said upper nozzle plenum of said heater assembly of said main portion and said lower nozzle plenum of said heater assembly of said main portion and enters upper nozzles of said heater assembly of said main portion and lower nozzles of said heater assembly of said main portion, respectively;

wherein said heated air leaves said upper nozzles of said heater assembly of said main portion and said lower nozzles of said heater assembly of said main portion and enters into a passageway of a heating zone of said heater assembly of said main portion for interfacing with the at least one of the delicate knit fabrics and the sensitive knit fabrics; and wherein said heated air leaves said passageway of said heating zone of said heater assembly of said main portion where an exhaust fan of said heater assembly of said main portion exhausts said heated air therefrom, while a portion returns.

11. The heat setter of claim 1, wherein said support assembly of said main portion comprises a tenter frame;

wherein said tenter frame of said support assembly of said main portion is internal to said housing of said main portion;

wherein said tenter frame of said support assembly of said main portion traverses said heating zone of said heater assembly of said main portion; and wherein said tenter frame of said support assembly of said main portion is for assisting in moving the at least one of the delicate knit fabrics and the sensitive knit fabrics through said heating zone of said heater assembly of said main portion so as to preserve the width of the at least one of the delicate knit fabrics and the sensitive knit fabrics as the at least one of the delicate knit fabrics and the sensitive knit fabrics passes through said heating zone of said heater assembly of said main portion.

12. The heat setter of claim 1, wherein said support assembly comprises an array of hollow tubes;

wherein said array of hollow tubes of said support assembly are disposed internal to said housing; and wherein said array of hollow tubes of said support assembly are for supporting and avoiding the at least one of the stretching, the marking, and the drooping of the at least one of the delicate knit fabrics and the sensitive knit fabrics going through said heating zone of said heater assembly of said main portion.

13. The heat setter of claim 12, wherein said array of hollow tubes of said support assembly are cylindrical tubes.

14. The heat setter of claim 12, wherein said array of hollow tubes of said support assembly introduce a waving effect to keep the at least one of the delicate and the sensitive knit fabrics from overheating on said array of hollow tubes of said support assembly.

15. The heat setter of claim 12, wherein said support assembly comprises a coolant;

wherein said coolant of said support assembly passes in said array of hollow tubes of said support assembly;

wherein said coolant of said support assembly is circulated by said array of hollow tubes of said support assembly; and wherein said coolant of said support assembly flows counter to a path of the at least one of the delicate knit fabrics and the sensitive knit fabrics.

16. The heat setter of claim 15, wherein said coolant of said support assembly is at least one of air, water, an inert gas, a commercially available liquid coolant, and a commercially available gaseous coolant.

17. The heat setter of claim 15, wherein said support assembly comprises spargers;

wherein said spargers of said support assembly are disposed at each end of said array of hollow tubes of said support assembly, respectively;

wherein said spargers of said support assembly are shaped to provide a smooth flow of the at least one of the delicate knit fabrics and the sensitive knit fabrics onto said array of hollow tubes of said support assembly;

wherein said spargers of said support assembly are shaped to provide a smooth flow of the at least one of the delicate knit fabrics and the sensitive knit fabrics away from said array of hollow tubes of said support assembly;

wherein said spargers of said support assembly deliver said coolant of said support assembly to said array of hollow tubes of said support assembly; and wherein said spargers of said support assembly collect said coolant of said support assembly from said array of hollow tubes of said support assembly.

* * * * *